US010226929B2

(12) United States Patent
Asano

(10) Patent No.: US 10,226,929 B2
(45) Date of Patent: Mar. 12, 2019

(54) HEAD CLEANER, MAINTENANCE DEVICE, AND LIQUID DISCHARGE APPARATUS

(71) Applicant: Yukihiro Asano, Kanagawa (JP)

(72) Inventor: Yukihiro Asano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/729,822

(22) Filed: Oct. 11, 2017

(65) Prior Publication Data

US 2018/0126737 A1 May 10, 2018

(30) Foreign Application Priority Data

Nov. 10, 2016 (JP) ..... 2016-219988
Sep. 20, 2017 (JP) ..... 2017-180184

(51) Int. Cl.
*B41J 2/165* (2006.01)

(52) U.S. Cl.
CPC ..... *B41J 2/16544* (2013.01); *B41J 2/16505* (2013.01); *B41J 2/16508* (2013.01); *B41J 2/16535* (2013.01); *B41J 2/16538* (2013.01); *B41J 2/16541* (2013.01); *B41J 2/165* (2013.01); *B41J 2002/1655* (2013.01); *B41J 2002/16558* (2013.01); *B41J 2002/16594* (2013.01)

(58) Field of Classification Search
CPC ..... B41J 2/16544; B41J 2/16508; B41J 2/16505; B41J 2/165; B41J 2002/16594; B41J 2002/16558
See application file for complete search history.

(56) References Cited

U.S. PATENT DOCUMENTS

| | | | | |
|---|---|---|---|---|
| 9,676,195 | B2 * | 6/2017 | Coma Vives | B41J 2/16535 |
| 2014/0132668 | A1 | 5/2014 | Takeuchi | |
| 2014/0253626 | A1 | 9/2014 | Masaoka et al. | |
| 2015/0062223 | A1 | 3/2015 | Takeuchi et al. | |
| 2015/0097894 | A1 | 4/2015 | Masaoka et al. | |
| 2016/0257113 | A1 | 9/2016 | Takeuchi et al. | |
| 2016/0325550 | A1 | 11/2016 | Masaoka et al. | |
| 2017/0253044 | A1 | 9/2017 | Ohnishi et al. | |

FOREIGN PATENT DOCUMENTS

| | | |
|---|---|---|
| JP | 2013-111898 | 6/2013 |
| JP | 2013-173244 | 9/2013 |
| JP | 2014-008763 | 1/2014 |

* cited by examiner

*Primary Examiner* — Geoffrey S Mruk
(74) *Attorney, Agent, or Firm* — Oblon, McClelland, Maier & Neustadt, L.L.P.

(57) ABSTRACT

A head cleaner for a liquid discharge apparatus, the head cleaner includes a first wiper to wipe, in a wiping direction, a nozzle face of a head that discharges liquid from nozzles on the nozzle face, and a second wiper to wipe the nozzle face of the head. The first wiper is belt-shaped, and the second wiper is a blade movable between a wiping position where the second wiper wipes the nozzle face and a cleaning position where the second wiper is cleaned by the first wiper.

12 Claims, 16 Drawing Sheets

HEAD CLEANER, MAINTENANCE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2016-219988, filed on Nov. 10, 2016 in the Japan Patent Office and Japanese Patent Application No. 2017-180184, filed on Sep. 20, 2017 in the Japan Patent Office, the entire disclosures of which are hereby incorporated by reference herein.

BACKGROUND

Technical Field

Aspects of the present disclosure relate to a head cleaner, a maintenance device incorporating the head cleaner, and a liquid discharge apparatus incorporating the head cleaner.

Related Art

A liquid discharge apparatus includes a liquid discharge head that discharges liquid from nozzles formed therein and a maintenance device for maintaining the nozzles in good operational condition. The liquid discharge head includes a nozzle plate in which a plurality of nozzles is formed. The maintenance device includes a head cleaner, for example. The head cleaner includes a cap for capping a surface of the nozzle plate and a wiper for wiping the surface of the nozzle plate.

Conventional head cleaners include a blade for wiping the nozzle face and a web-like cleaner. The web-like cleaner is movably provided on the head cleaner and removes waste liquid adhered on the blade. In addition, a web for wiping the surface of the nozzle face is also used as a wiper member to wipe the nozzle face of the head.

SUMMARY

In an aspect of this disclosure, a novel head cleaner for a liquid discharge apparatus, the head cleaner includes a first wiper to wipe, in a wiping direction, a nozzle face of a head that discharges liquid from nozzles on the nozzle face, and a second wiper to wipe the nozzle face of the head. The first wiper may be belt-shaped, and the second wiper may be a blade. The second wiper may be movable between a wiping position for wiping the nozzle face and a cleaning position where the second wiper is cleaned by the first wiper.

In still another aspect of this disclosure, a maintenance device for a head that discharges liquid from nozzles, the device includes a cap to cap the head, and the head cleaner according to the aspect described-above.

In still another aspect of this disclosure, a liquid discharge apparatus includes a head to discharge liquid from nozzles, and the head cleaner according to the aspect described-above.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
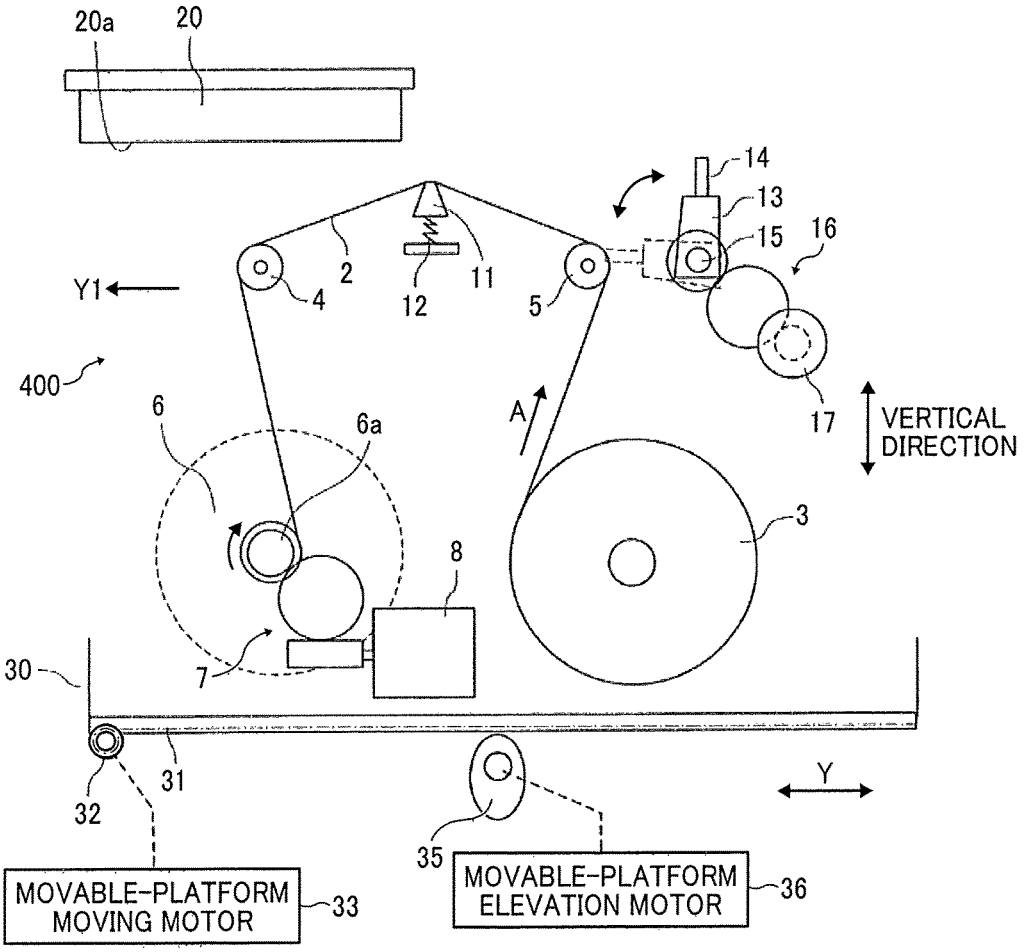
FIG. 1 is a schematic side view of a head cleaner according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms “a”, “an”, and "the" are intended to include the plural forms as well, unless the context clearly indicates otherwise.

Referring now to the drawings, wherein like reference numerals designate identical or corresponding parts throughout the several views, embodiments of the present disclosure are described below.

Referring now to the drawings, wherein like reference numerals designate identical or corresponding parts throughout the several views, embodiments of the present disclosure are described below.

A head cleaner 400 of a first embodiment of the present disclosure is described below with reference to FIGS. 1 and 2.

Figure 2:
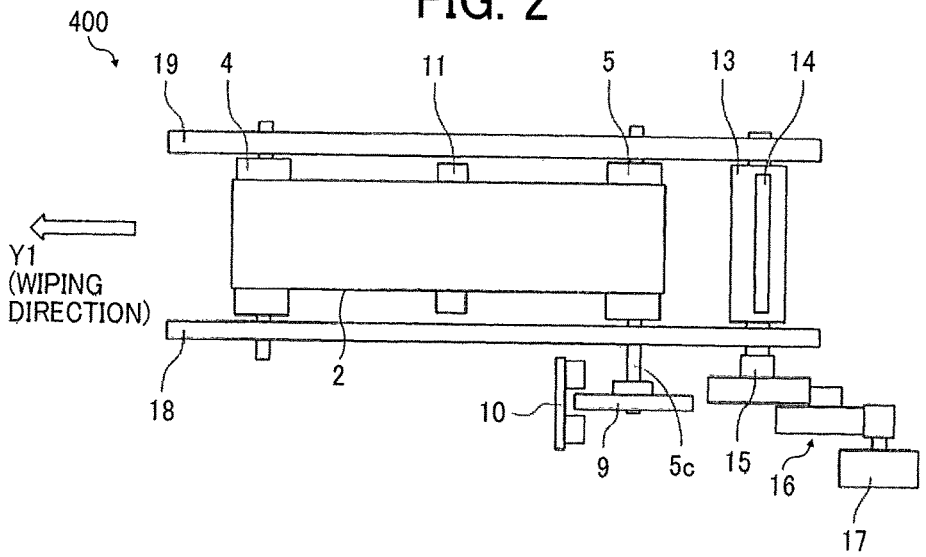
FIG. 2 is a plan view of the head cleaner of FIG. 1.

FIG. 1 is a side view of the head cleaner 400 according to an embodiment of the present disclosure. FIG. 2 is a plan view of the head cleaner 400.

The head cleaner 400 is a wiping mechanism for wiping and cleaning a nozzle face 20*a* of the liquid discharge head (hereinafter, simply referred to as "head"). The head cleaner includes a web 2 and a wiper 14. The web 2 is belt-shaped and acts as a first wiper for wiping the nozzle face 20*a*. The wiper 14 is an elastic blade acting as a second wiper. The web 2 and the wiper 14 are held between side plates 18 and 19 illustrated in FIG. 2.

Preferably, the web 2 is made of a sheet-like material having good absorption and liquid resistance to prevent scuffing and generating dust. Specific examples of such materials include, but are not limited to, non-woven fabric, cloth, film, and paper.

The web 2 is drawn from a feeding roller 3 and wound up by a winding roller 6 via guide rollers 4 and 5. The guide rollers 4 and 5 are rotatably supported by the side plates 18 and 19. The guide rollers 4 and 5 act as guide rollers to guide the web 2. The feeding roller 3 is disposed upstream in a wiping direction and the winding roller 6 is disposed downstream in the wiping direction. The wiping direction Y1 is indicated by an arrow Y1 in FIGS. 1 and 2. Web 2 is wound in a direction along the wiping direction. Here, the "wiping direction" is a direction in which the head cleaner 400 moves relative to the nozzle face 20*a* of the head 100.

A pushing part 11 is disposed between the two guide rollers 4 and 5. The pushing part 11 pushes the web 2 against the nozzle face 20*a*. The pushing part 11 has a spring 12 to push the web 2 against the nozzle face 20*a* with a predetermined pushing force when the web 2 contacts the nozzle face 20*a*.

Here, the head cleaner 400 may include a mechanism for changing the force of the spring 12. The head cleaner 400 has a memory such as a read-only memory (ROM) 502 illustrated in FIG. 20 to store information related to the pushing force of the spring 12 according to a tension applied on the web 2 that corresponds to material used for the web 2. Then, the head cleaner 400 recognizes the material of the web 2 and applies the pushing force on the web 2 according to the tension corresponding to the material of the web 2 by the spring 12.

A drive force of the drive motor 8 is transmitted to a shaft 6*a* of the winding roller 6 via the transmission mechanism 7 consisting of a gear train.

A code wheel 9 is mounted on a rotational axis 5*c* of the guide roller 5. The head cleaner 400 includes an encoder sensor 10 that detects a pattern formed on the code wheel 9. The encoder sensor 126 includes a transmissive photosensor. The code wheel 9 and the encoder sensor 10 configure a rotary encoder (sub scanning encoder) that detects a moving distance (amount of movement) of the web 2 to control movement of the web 2.

The wiper 14 is disposed upstream in the wiping direction Y1 of the web 2. The wiper 14 is held with a wiper holder 13. An end of the axis 15 of the wiper holder 13 is rotatably supported by the side plates 18 and 19. The wiper 14 is disposed upstream of a position where the web 2 contacts the nozzle face 20*a* (the position of the pushing part 11) in a moving direction of the web 2. The moving direction of the web 2 is indicated by arrow A in FIG. 1.

Optionally, the wiper 14 may be disposed at the guide roller 4 side (downstream side of the pushing part 11) in the wiping direction Y1. That is, the wiper 14 may be disposed in downstream side of the web 2 in the wiping direction Y1. In this case, the nozzle face 20*a* is first wiped by the wiper 14 and then wiped by the web 2. Thus, the position of the feeding roller 3 and the winding roller 6 may be exchanged in order to reverse the moving direction of the web 2.

When the wiper 14 is disposed downstream side of the web 2 in the wiping direction Y1 and the conveyance direction A of the web 2 is identical with the wiping direction Y1, a part of the web 2 stained by contacting the nozzle face 20*a* moves to the cleaning position to clean the wiper 14. Thus, it is necessary to convey the web 2 until an unused part of the web 2 reaches the cleaning position to clean the wiper 14. Therefore, the unused part of the web 2 conveyed to the cleaning position is wasted. The unused part of the web 2 is not stained by the liquid on the nozzle face 20*a* before contacting the nozzle face 20*a*.

Thus, the wiper 14 (second wiper) is disposed upstream of the web 2 (first wiper) in the conveyance direction A of the web 2 to reduce wasteful consumption of the web 2.

Further, a rotational force of a drive motor 17 such as a stepping motor is transmitted to the axis 15 of the wiper holder 13 via the transmission mechanism 16. Thus, the drive motor 17 drives to rotate the wiper holder 13.

Thereby, the wiper 14 is movable between a wiping position where the wiper is contactable with the nozzle face 20*a* and a cleaning position where the wiper 14 contacts the web 2. The wiping position is indicated by solid line in FIG. 1, and the cleaning position is indicated by broken line in FIG. 1. A conveyance direction (moving direction A) of the web 2 is a direction from upstream to downstream in the wiping direction Y1. The cleaning position is disposed upstream of the position where the web 2 contacts the nozzle face 20*a* (the position of the pushing part 11).

Thus, the web 2 (first wiper) is conveyed in a direction from upstream to downstream in the wiping direction Y1 of the web 2 (first wiper), and the cleaning position of the wiper 14 (second wiper) is disposed at upstream of a contact position where the first wiper contacts the nozzle face 20*a* of the head 20.

In this case, the cleaning position where the wiper 14 contacts the web 2 is disposed at the position where the wiper 14 faces the guide roller 5 that guides the web 2. Thereby, it is possible to reliably contact the wiper 14 with the web 2.

The web 2, the feeding roller 3, the winding roller 6, the guide rollers 4 and 5, the transmission mechanism 7, the drive motor 8, the wiper holder 13, the transmission mechanism 16, the drive motor 17 are all mounted on a movable platform 30. The movable platform 30 is movable relative to the head 20.

The movable platform 30 is movable in the direction of wiping Y that is parallel to an arrangement direction of nozzles 25 (See FIG. 19) of the head 20 (direction along nozzle face 20*a*). A movement of the movable platform 30 in the wiping direction Y is performed by a rack 31, a pinion 32, and a movable-platform moving motor 33 that rotates the pinion 32 to move the movable platform 30.

The movable platform 30 is movable in a vertical direction (elevation direction) that is a direction in which the web 2 and the wiper 14 is advanced toward and retracted from the nozzle face 20*a*. An elevation of the movable platform 30 is realized by an elevation mechanism including a cam 35 and a movable-platform elevation motor 36 that rotates the cam 35.

Figure 3:
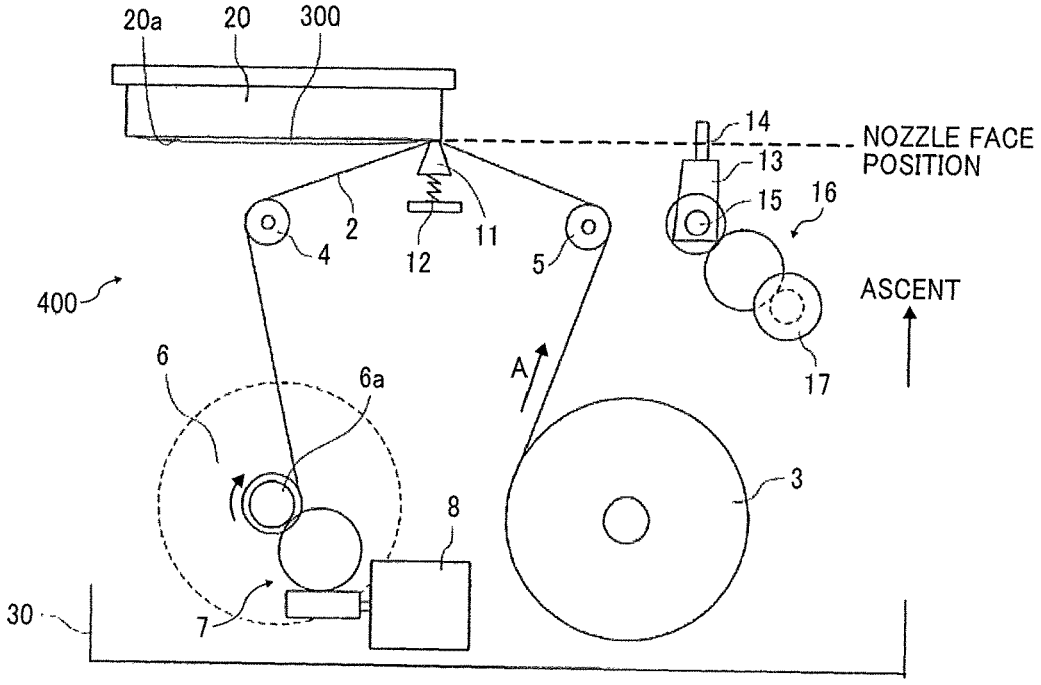
FIG. 3 is a schematic side view of the head cleaner according to the first embodiment for describing the wiping operation.
Figure 4:
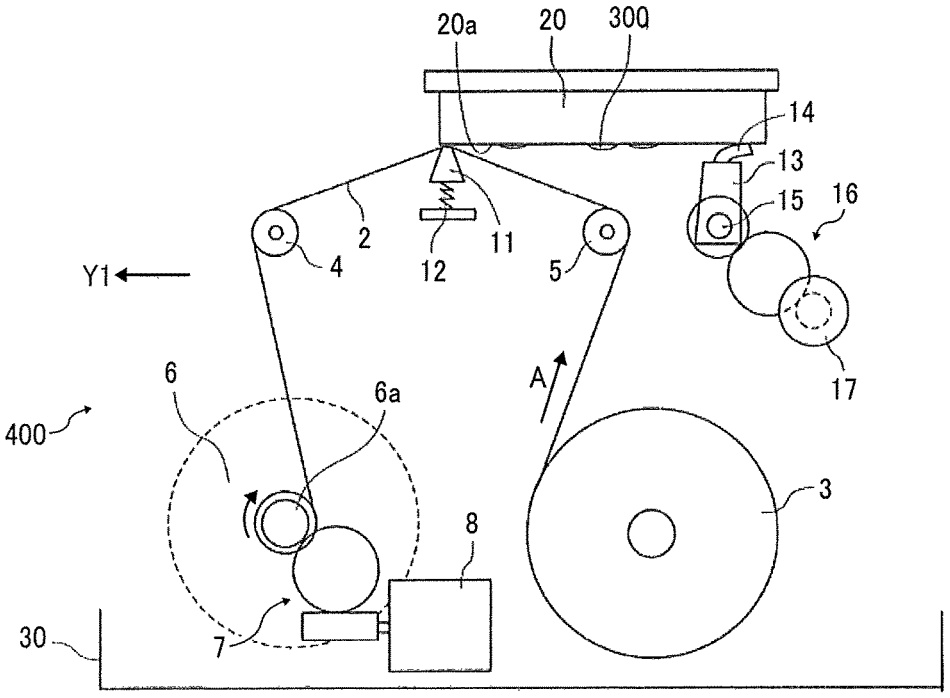
FIG. 4 is a side view during a wiping operation.
Figure 5:
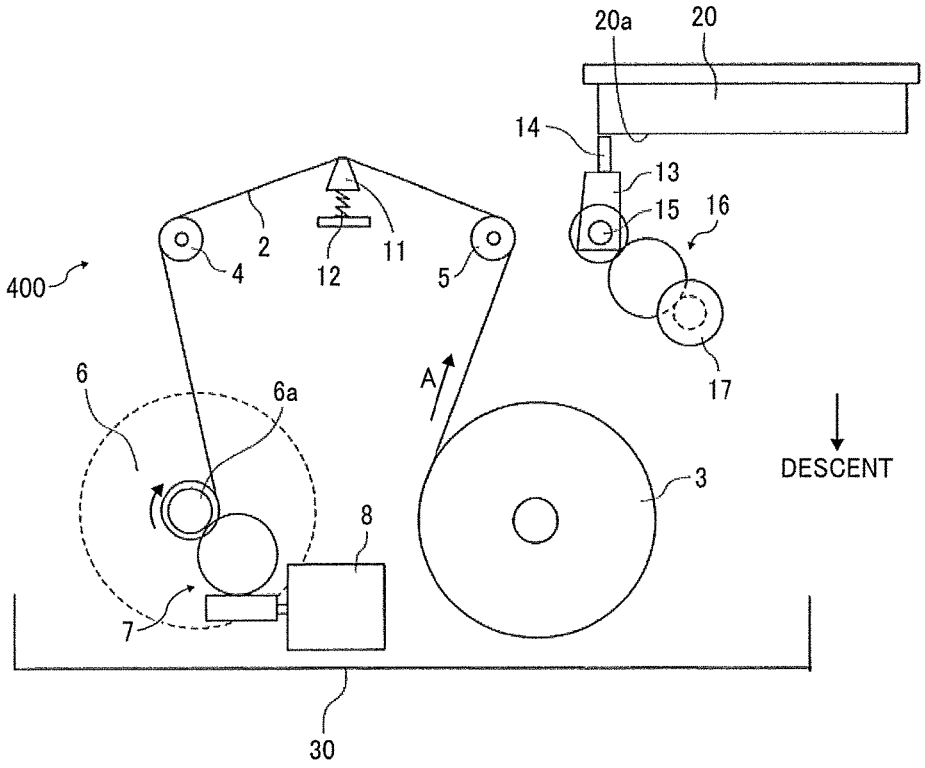
FIG. 5 is a side view illustrating a wiping ending position.

The wiping operation according to the present embodiment is described below with reference to FIGS. 3 through 5. FIG. 3 is a side view illustrating a wiping start position. FIG. 4 is a side view during a wiping operation. FIG. 5 is a side view illustrating a wiping ending position.

When the nozzle face 20*a* of the head 20 is cleaned by the head cleaner 400, as illustrated in FIG. 3, the movable platform 30 elevates, and the web 2 is pushed against one end part of the nozzle face 20*a* of the head 20 with a predetermined pushing force. This one end part of the nozzle face 20*a* becomes the wiping start position of the web 2. At this time, the wiper 14 does not contact the nozzle face 20*a*.

Then, as illustrated in FIG. 4, the movable platform 30 moves in the wiping direction Y1. Thereby, the liquid (waste liquid) 300 remained on the nozzle face 20*a* of the head 20 is wiped and absorbed (thus removed) by the web 2.

Next, the wiper 14 contacts the nozzle face 20*a* from the one end part of the nozzle face 20*a* when the web 2 moves to the predetermined position. The wiper 14 moves in the wiping position Y1 while wiping the waste liquid 300 that is left and remains after the wiping by the web 2 with the movement of the movable platform 30.

Then, as illustrated in FIG. 5, at the position where the wiper 14 reaches another end of the nozzle face 20*a*, the movement of the movable platform 30 is stopped. Then, the movable platform 30 is lowered so that the wiper 14 is separated from the nozzle face 20*a*.

Thereby, the present embodiment can prevent the waste liquid from being scattered by the wiper 14 when the wiper is returned to the upright status from the deformed status. The wiper 14 tosses off the waste liquid adhered on the wiper 14 to a front of the wiping direction Y1 when the wiper is returned to the upright status from the deformed status.

Figure 6:
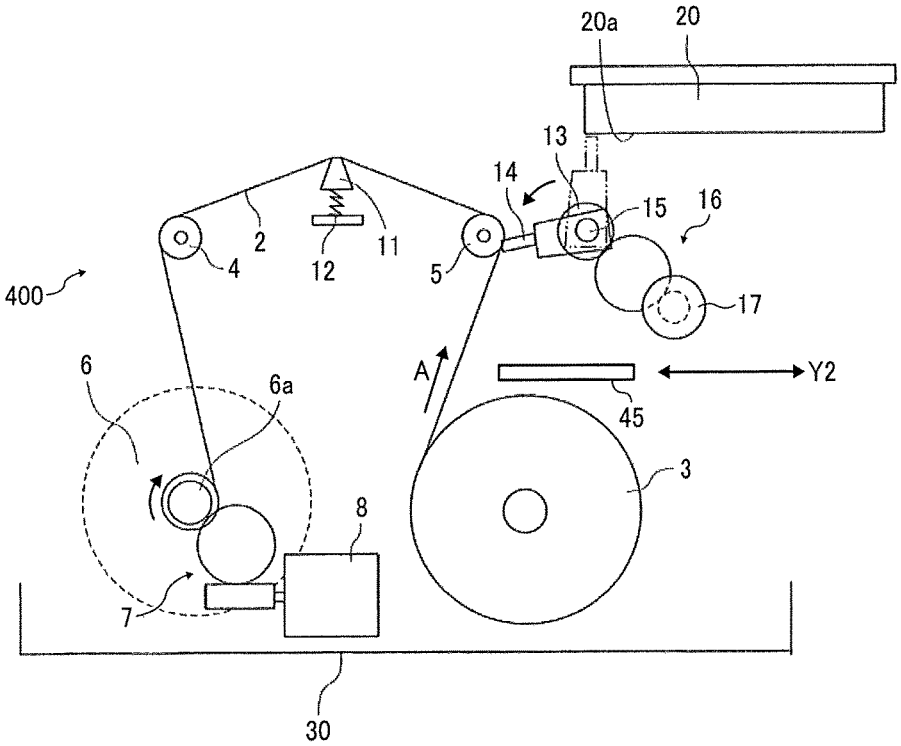
FIG. 6 is a side view of the wiper at the cleaning position used for describing the cleaning operation.
Figure 7:
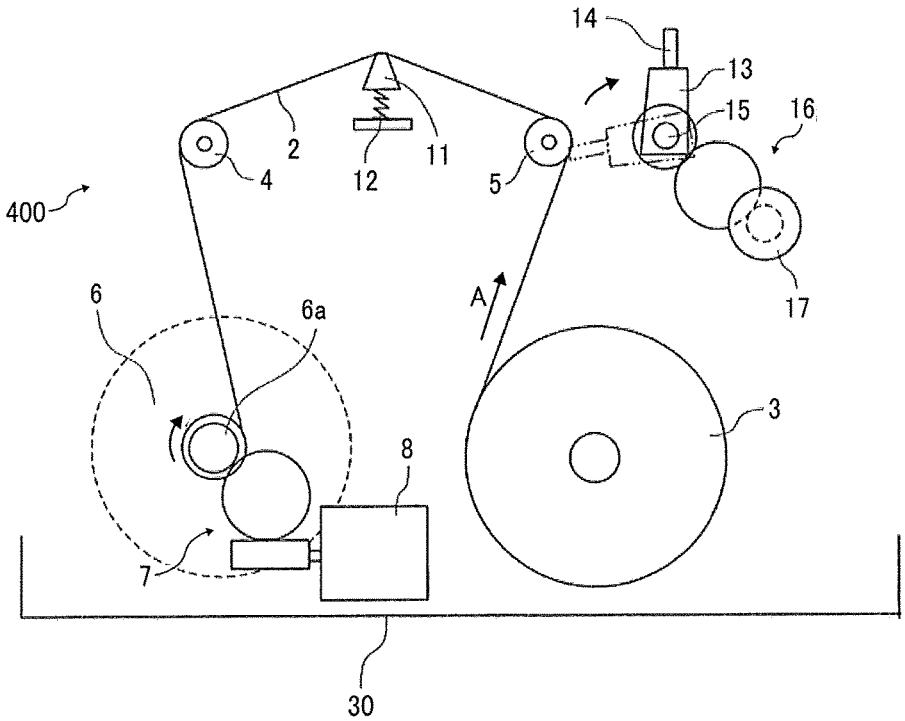
FIG. 7 is a side view of the wiper after the cleaning operation.

Next, the cleaning operation of the wiper 14 is described with reference to FIGS. 6 and 7. FIG. 6 is a side view of the wiper 14 at the cleaning position used for explaining the cleaning operation. FIG. 7 is a side view of the wiper 14 after the cleaning operation.

When the wiping operation is performed once or more than once, the wiper 14 is disposed at the wiping end position as illustrated in FIG. 6. Then, the wiper 14 is rotated in a direction indicated by arrow in FIG. 6 from the wiping position (indicated by imaginal line) to the cleaning position (indicated by solid line) where the wiper 14 contacts the web 2 by driving the drive motor 17.

At this time, the wiper 14 keeps a status of contacting the web 2 for a predetermined time to reliably absorb the waste liquid adhered on the wiper 14 by the web 2. The rotational amount of the wiper 14 (contact amount with web 2) and contact time may be arbitrary set. Further, the position (contact angle) between an end of the wiper 14 and the web 2 may be varied according to a hardness of material of the wiper 14 or a usage status of the wiper 14 with change over time.

Further, a contact angle between an end of the wiper 14 and the web 2 may be varied according the hardness of the material of the wiper 14 and usage status of the wiper 14 that changes over time.

Further, if the wiper 14 contacts the web 2 that locates closed to the guide roller 5 for a predetermined time, the waste liquid may be scattered on the feeding roller 3, on which unused web 2 is wound around. Thus, the unused part of the web 2 may be stained by the scattered waste liquid.

A plate-like shielding member (shield) 45 may be provided to receive the scattered waste liquid on a space between the feeding roller 3, the wiper holder 13, and the wiper 14 in FIG. 6. The shielding member 45 may be configured to advance and retract in Y2 direction in FIG. 6 in conjunction with a rotational movement of the axis 15 of the wiper holder 13.

Then, when the absorption and removal of the waste liquid adhered on the wiper 14 to the web 2 is completed and the wiper 14 is cleaned, the wiper 14 is rotated in reverse direction as illustrated in FIG. 7. Thus, the wiper is returned to the upright position that is the initial wiping position.

Figure 8:
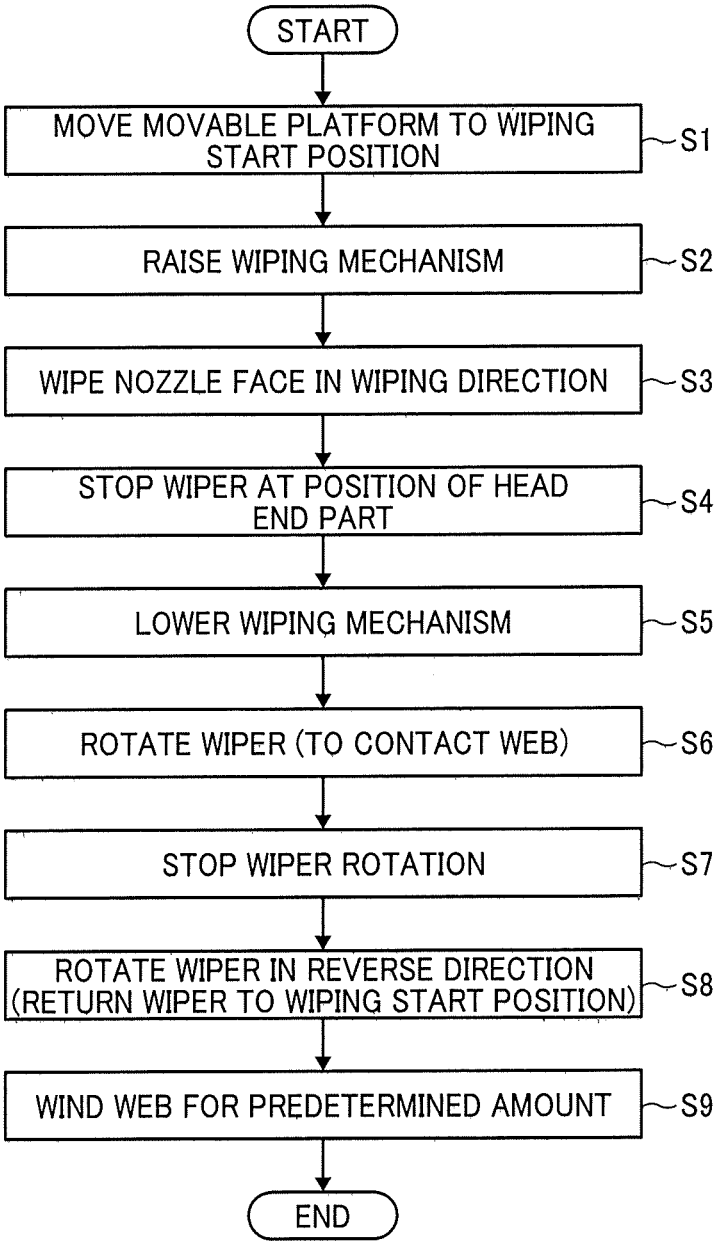
FIG. 8 is a flowchart for explaining a wiping operation according to the first embodiment of the present disclosure.

Next, steps in the wiping operation and the cleaning operation will be described below with reference to a flowchart of FIG. 8.

The movable platform 30 moves to the position where the web 2 locates at the wiping start position in the wiping direction Y1 (step S1). Then, the movable platform 30 ascends for a predetermined amount to raise and push the web 2 against the nozzle face 20*a* with the predetermined pushing force (step S2). Then, the movable platform 30 moves in the wiping direction Y1 to perform the wiping operation of the web 2 and the wiper 14 (step S3).

Then, the wiper 14 stops wiping when the wiper 14 reaches the end part of the head 20 (step S4). The movable platform 30 descends to lower the wiping mechanism (cleaning apparatus) to separate the wiper 14 from the nozzle face 20*a* (step S5).

Then, the wiper 14 rotates to contact the web 2 (step S6). The wiper 14 keeps contacting with the web 2 for a predetermined stopping time to clean the wiper 14 (step S7). Then, the wiper 14 rotates reversely to return to the wiping start position (step S8).

Then, the winding roller 6 is rotated to wind the web 2 for a predetermined amount for preparing for the next wiping operation (step S9).

In this way, the wiping operation of the first wiper (web 2) and the second wiper (wiper 14) can be performed. Further, the wiping operation can be executed in a short time. The second wiper (wiper 14) can also be cleaned by the first wiper (web 2).

Accordingly, the present embodiment can clean the wiper with a simple configuration while reducing the wiping time.

In the present embodiment, a conveyance direction of the first wiper (web 2) is a direction from the upstream (feeding roller 3 side) to the downstream side (winding roller 6 side) in the wiping direction Y1. The cleaning position is disposed upstream of the position where the first wiper (web 2) contacts the nozzle face 20*a* (the position of the pushing part 11). Thus, the second wiper (wiper 14) can be cleaned by the second wiper (web 2) that is always in a clean (unused) condition.

Figure 9:
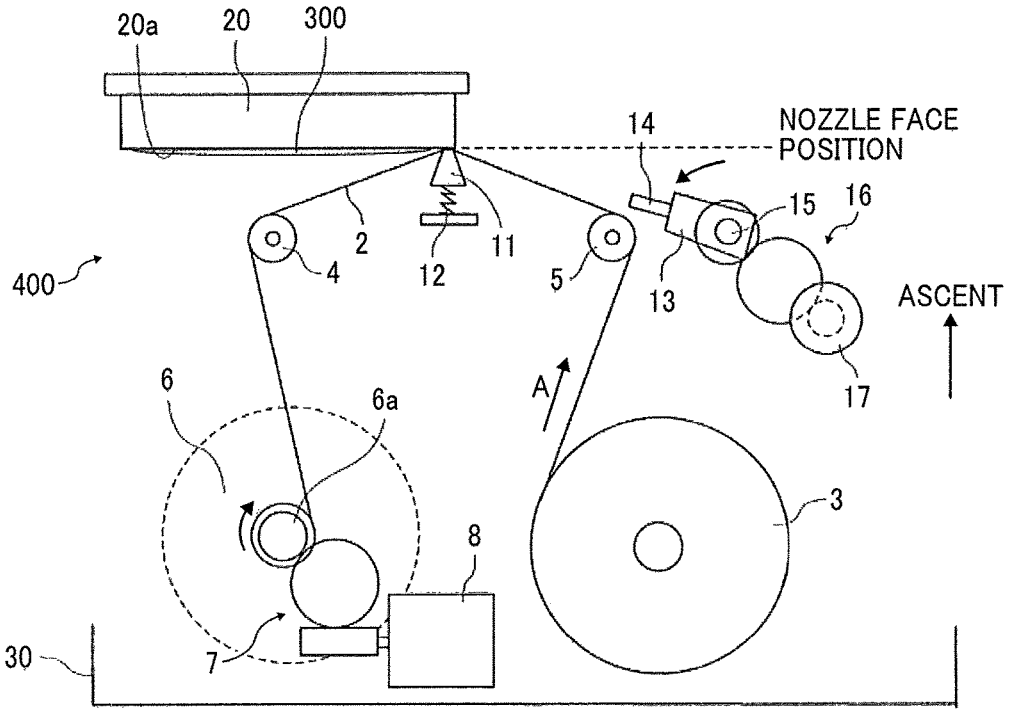
FIG. 9 is a schematic side view of the head cleaner according to the second embodiment for describing the wiping operation.

A second embodiment according to the present disclosure is described below with reference to FIG. 9. FIG. 9 is a schematic side view of the head cleaner 400 according to the second embodiment for describing the wiping operation.

In the second embodiment, the wiper 14 is movable to a retracted position where the wiper 14 does not contact the nozzle face 20*a*. A movement of the wiper 14 to the retracted position can be controlled with a rotation amount of the drive motor 17

In the present embodiment, a position other than the wiping position where the wiper 14 contacts the nozzle face 20*a* and the cleaning position where the wiper 14 contact the web 2 is set as the retracted position. Alternatively, the cleaning position may also serve as the retracted position. If an elevation of the web 2 and an elevation of the wiper 14 are performed by elevation mechanisms provided separately for each of the web 2 and the wiper 14, the initial position of the wiper 14 can set to the retracted position, so that the wiping operation can be performed by the web 2 alone.

For example, the wiping operation by the web 2 alone is performed when the temperature of the head 20 is lower than a predetermined temperature. The viscosity of the liquid increases when the temperature of the head is lower than the predetermined temperature. Thus, it is difficult to remove the waste liquid adhered on the nozzle face 20*a*. In this case, the present embodiment can wipe the nozzle face 20*a* with the web 2 only and then wipe the nozzle face 20*a* with the wiper 14. Thus, the present embodiment can reliably clean the nozzle face 20*a*.

By performing the wiping operation with the web 2 multiple times, the waste liquid adhered on the nozzle face 20*a* can be reliably absorbed by the web 2.

The wiping operation only by the web 2 may be performed even when a predetermined time has been passed since the completion of the previous wiping operation. The viscosity of the waste liquid on the nozzle face 20*a* increases with the increase in the waiting time. Thus, the wiping operation after predetermined waiting time has been passed is performed only by the web 2 to remove the waste liquid from the nozzle face 20*a*. At this time, the wiping operation only by the web 2 may be performed for plurality of times.

The number of wiping by the web 2 may be selectable according to parameters of an amount of the waste liquid adhered on the nozzle face 20*a* or material of the web 2 in addition to a parameter of predetermined waiting time. For example, the number of wiping by the web 2 may be selected as once or as plurality of times according to the above-mentioned parameters.

Further, the number of contacting the wiper 14 with the web 2 may be selectable for a series of operations in which the wiper 14 is cleaned by the web 2 after the wiping of the nozzle face 20*a* with the web 2 and the wiper 14.

Thereby, the wiping time can be further reduced because the cleaning process of the wiper 14 does not have to be performed all the time.

Here, the winding operation of the web 2 after the completion of the wiping operation is described with reference to FIG. 8.

The winding amount of the web 2 is set to a predetermined amount. It is preferable to reduce the winding amount of web 2 to reduce frequency of exchanging the web 2. Thus, in the present embodiment, the winding amount of the web 2 when the wiping operation of the wiper 14 is not performed is set to be smaller than the winding amount of the web 2 when the wiping operation of the wiper 14 is performed. Thereby, a consumption amount of the web can be reduced.

A third embodiment according to the present disclosure is described with reference to FIGS. 10A through 10C.

Figure 10A:
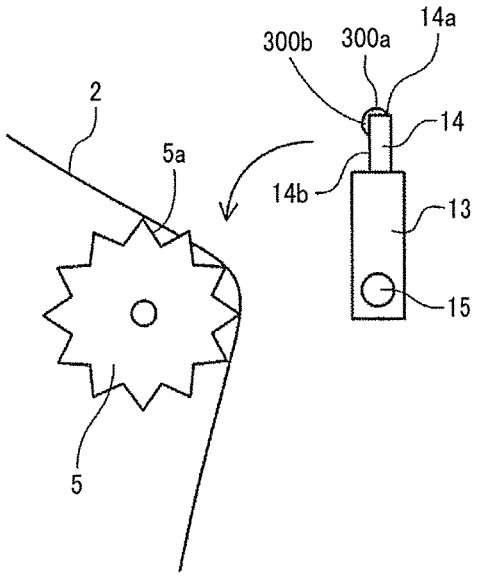
FIGS. 10A through 10C are enlarged side views of a portion of the web and the wiper of the head cleaner according to a third embodiment of the present disclosure.
Figure 10B:
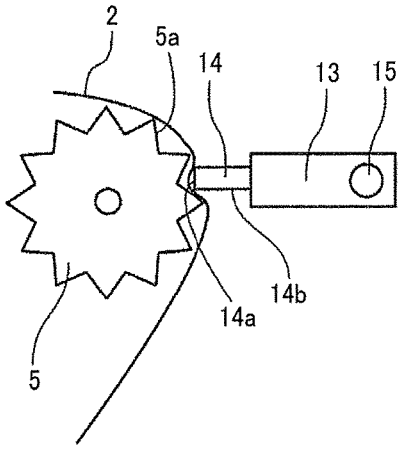
Figure 10C:
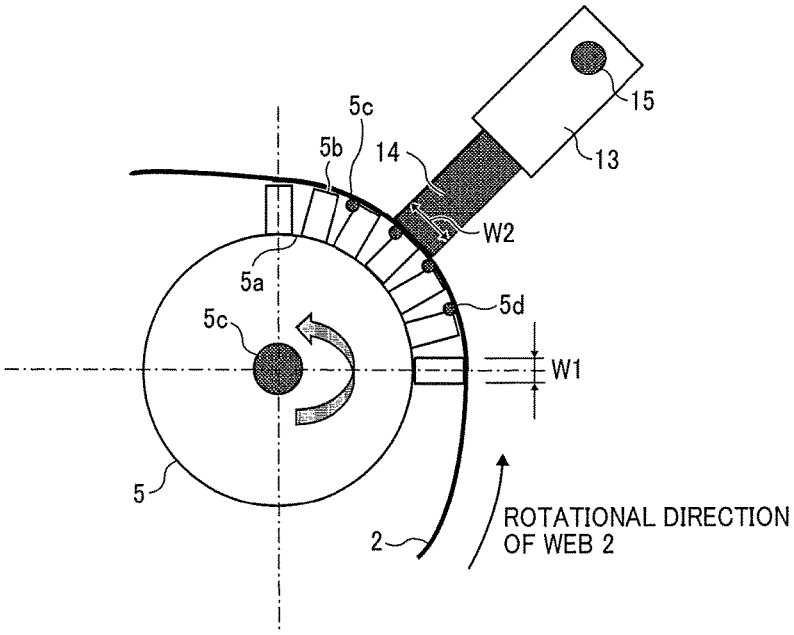

FIGS. 10A through 10C are enlarged side views of a portion of the web 2 and the wiper 14 of the head cleaner 400. The cleaning operation of the second wiper (wiper 14) by the web 2 is described with reference to FIGS. 10A through 10C.

In the present embodiment, the guide roller 5 that guides the web 2 includes recesses 5*a* that form uneven outer circumference or shape. The recesses 5*a* are extended along an axial direction of the guide roller 5.

Thereby, as illustrated in FIG. 10A, the waste liquid 300*a* and 300*b* adhered on a top face 14*a* and a side face (wiping face) 14*b* of the wiper 14 is reliably removed by the web 2.

When the wiper 14 wipes the nozzle face 20*a*, the waste liquid 300*a* and 300*b* are adhered on the top face 14*a* and side face 14*b* of the wiper 14. Therefore, it is necessary to remove the waste liquid adhered on two places (top face 14*a* and side face 14*b*) of the wiper 14.

Thus, the outer shape of the guide roller 5 that faces the wiper 14 at the cleaning position is configured to be uneven shape having plurality of recesses 5*a*. Thereby, as illustrated in FIG. 10B, by contacting the wiper 14 to the recess 5*a*, the waste liquid 300*a* and 300*b* adhered on a top face 14*a* and a side face (wiping face) 14*b* of the wiper 14 is reliably absorbed by the web 2.

The guide roller 5 in FIG. 10C has an uneven outer shape and includes a recessed 5*a* and a convex part 5*b*.

As illustrated in FIG. 10C, a relationship of W1<W2 is established between a width (W1) of an upper face of convex part 5*b* that contacts the web 2 and the thickness (W2) of the wiper 14.

When the above-described relationship of W1<W2 is established as illustrated in FIG. 10C, the wiper 14 contacts one of the edge 5*d* (indicated by filled solid circles in FIG. 10C) of the upper face of the convex part 5*b*, respectively, as the guide roller 5 rotates.

Thereby, the waste liquid 300*a* adhered on the wiper 14 is reliably absorbed by the web 2. In this case, number of the convex part 5*b* and width of the recesses 5*a* and the convex part 5*b* of the guide roller 5 are varied according to a thickness of the wiper 14.

A fourth embodiment according to the present disclosure is described with reference to FIG. 11.

Figure 11:
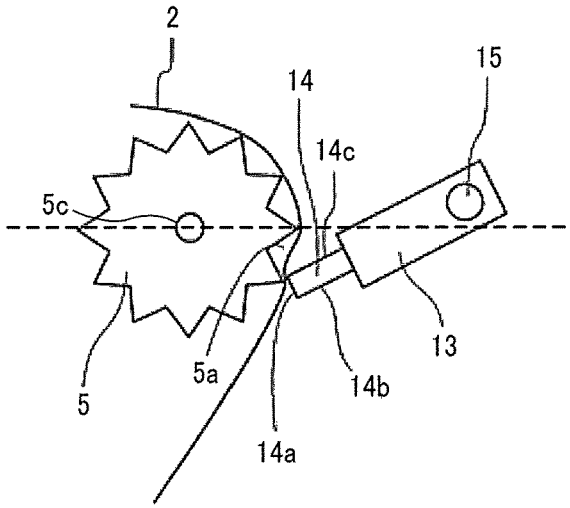
FIG. 11 is an enlarged side view of a portion of the web and the wiper of the head cleaner according to a fourth embodiment of the present disclosure.

FIG. 11 is an enlarged side view of a portion of the web 2 and the wiper 14 of the head cleaner 400. The cleaning operation of the second wiper (wiper 14) by the web 2 is described with reference to FIG. 11.

In the fourth embodiment, the wiper 14 is disposed at a position lower than the rotational axis 5*c* of the guide roller 5 when the wiper 14 is at the cleaning position. At this time, the wiper 14 is disposed at an upstream of a horizontal line (broken line in FIG. 11) of the rotational axis 5*c* in the conveyance direction of the web 2 when the web 2 is wound and conveyed in a counter clockwise direction in FIG. 11.

Thereby, the waste liquid adhered on a back face 14*c* can be absorbed by the web 2 when the wiper 14 rotates in reverse direction (clockwise direction) to return to the wiping position. The waste liquid adheres on the back face 14*c* of the wiper 14 when the waste liquid on the top face 14*a* protrudes to the back face 14*c* of the wiper 14.

Further, the third embodiment and the fourth embodiment may be combined to clean the wiper 14 at the position in FIG. 10B. Then, the wiper 14 temporality rotates in a counter clockwise direction to the position as illustrated in FIG. 11, and then the wiper 14 rotates in reverse direction (clockwise direction) to return to the wiping position.

Further, the uneven shape of the guide roller 5 has slits in an axial direction of the rotational axis 5*c* (direction perpendicular to the rotational direction of the rotational axis 5*c*). The slits on the uneven shaped guide roller 5 can clean the wiper 14 when the waste liquid adhered on the wiper 14 is absorbed by the web 2 because the waste liquid spreads evenly in a width direction of the rotational axis 5*c* by the slits and the uneven shape of the guide roller 5.

Figure 12:
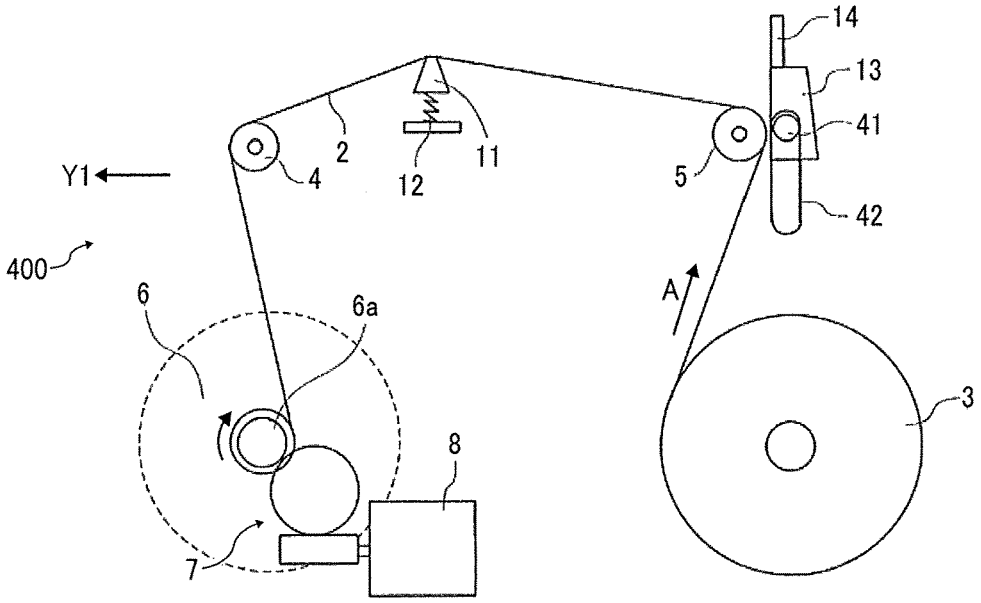
FIG. 12 is a schematic side view of the head cleaner according to the fifth embodiment of the present disclosure.
Figure 13:
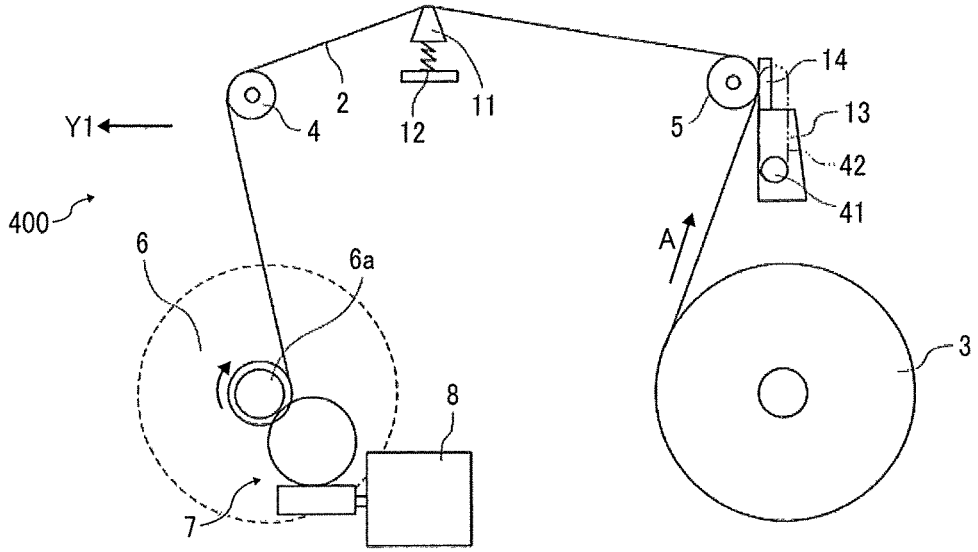
FIG. 13 is a side view used for explaining the fifth embodiment.

A fifth embodiment according to the present disclosure is described with reference to FIGS. 12 and 13. FIG. 12 is a schematic side view of the head cleaner 400 according to the fifth embodiment of the present disclosure. FIG. 13 is a side view used for explaining the fifth embodiment.

In the present embodiment, the wiper 14 is movable in a vertical direction. The head cleaner 400 includes guide grooves 42 on each of side plates, for example, that hold an axis 41 of the wiper holder 13 that holds the wiper 14. The guide grooves 42 guides the axis 41 in a vertical direction. The wiper holder 13 is moved vertically by a moving mechanism such as a solenoid.

Thereby, the wiper 14 descends from the wiping position as illustrated in FIG. 12 to the cleaning position as illustrated in FIG. 13. Thereby, the waste liquid adhered on the wiper 14 is absorbed and cleaned by the web 2 when the wiper 14 descends to the cleaning position.

The present embodiment can simplify a configuration of a drive mechanism (elevation mechanism) of the wiper 14 because the wiper 14 only moves vertically along the guide grooves 42.

The present embodiment can wipe the nozzle face 20*a* with the web 2 only as described-above by descending the wiper 14 to the cleaning position where the wiper does not contact the nozzle face 20*a*.

At this time, it is possible to effectively absorb the waste liquid adhered on the wiper 14 by the web 2 by moving the web 2 in an ascending direction opposite to the descending direction of the wiper 14 because friction force occurs between the wiper 14 and the web 2 during the movement of the wiper 14 and the web 2.

Figure 14:
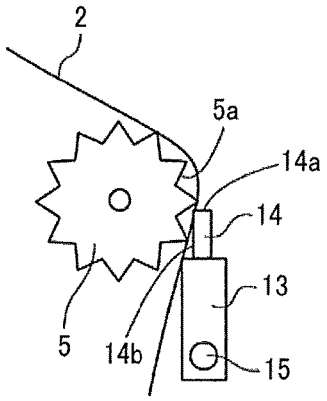
FIG. 14 is an enlarged side view of a portion of the web and the wiper of the head cleaner according to a sixth embodiment of the present disclosure.

A sixth embodiment according to the present disclosure is described with reference to FIG. 14. FIG. 14 is an enlarged side view of a portion of the web 2 and the wiper 14 of the head cleaner 400. The cleaning operation of the second wiper (wiper 14) by the web 2 is described with reference to FIG. 14.

The sixth embodiment uses the guide roller 5 for guiding the web 2 that has the uneven outer shape as similar to the above-described third embodiment in the above-described fifth embodiment.

In this configuration, the waste liquid adhered on the wiping face (side face) 14*b* of the wiper 14 is absorbed by the web 2 when the wiper 14 descends. Further, the waste liquid adhered on the top face 14*a* of the wiper 14 is absorbed by the web 2 when the wiper 14 ascends and to be inserted into the recess 5*a* of the guide roller 5.

Figure 15:
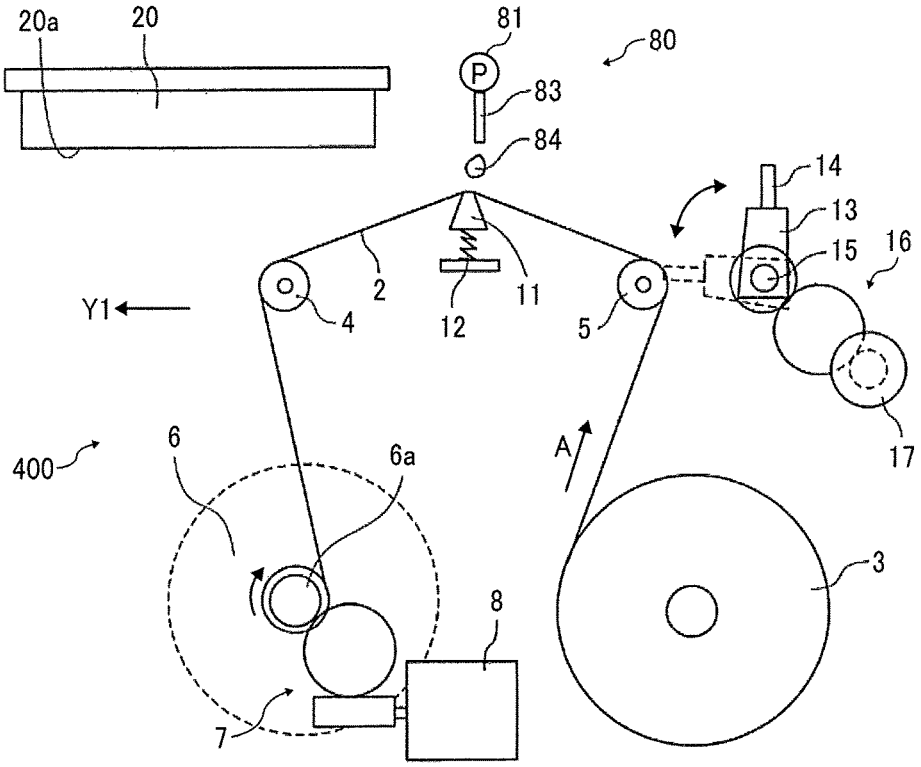
FIG. 15 is a schematic side view of the head cleaner according to the seventh embodiment of the present disclosure.
Figure 16:
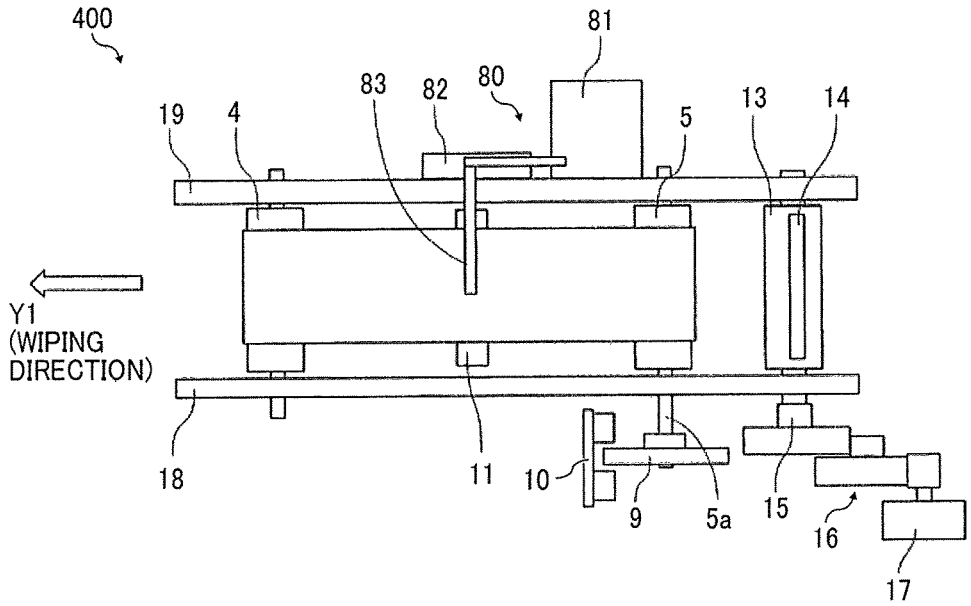
FIG. 16 is a plan view of the head cleaner of FIG. 15.

A seventh embodiment according to the present disclosure is described with reference to FIGS. 15 and 16. FIG. 15 is a schematic side view of the head cleaner 400 according to the seventh embodiment of the present disclosure. FIG. 16 is a plan view of the head cleaner 400.

The seventh embodiment includes a cleaning-liquid applying device 80 that applies cleaning liquid 84 to the web 2 in each of the above-described embodiments. Here, an example of providing the cleaning-liquid applying device 80 on the first embodiment is illustrated in FIGS. 15 and 16.

The cleaning-liquid applying device 80 includes a supply pump 81 and a supply tube 83, and a stand 82. The supply pump 81 supplies cleaning liquid 84 to the supply tube 83. The stand 82 supports the crawled supply tube 83.

Thereby, as illustrated in FIG. 15, by applying (dropping) the cleaning liquid 84 to the web 2 before wiping the nozzle face 20*a* by the web 2, the waste liquid adhered on the nozzle face 20*a* can be reliably absorbed and removed by the web 2.

A supply amount of the cleaning liquid 84 is controlled by controlling a drive time of the supply pump 81. The supply amount of the cleaning liquid 84 may be varied.

Figure 17:
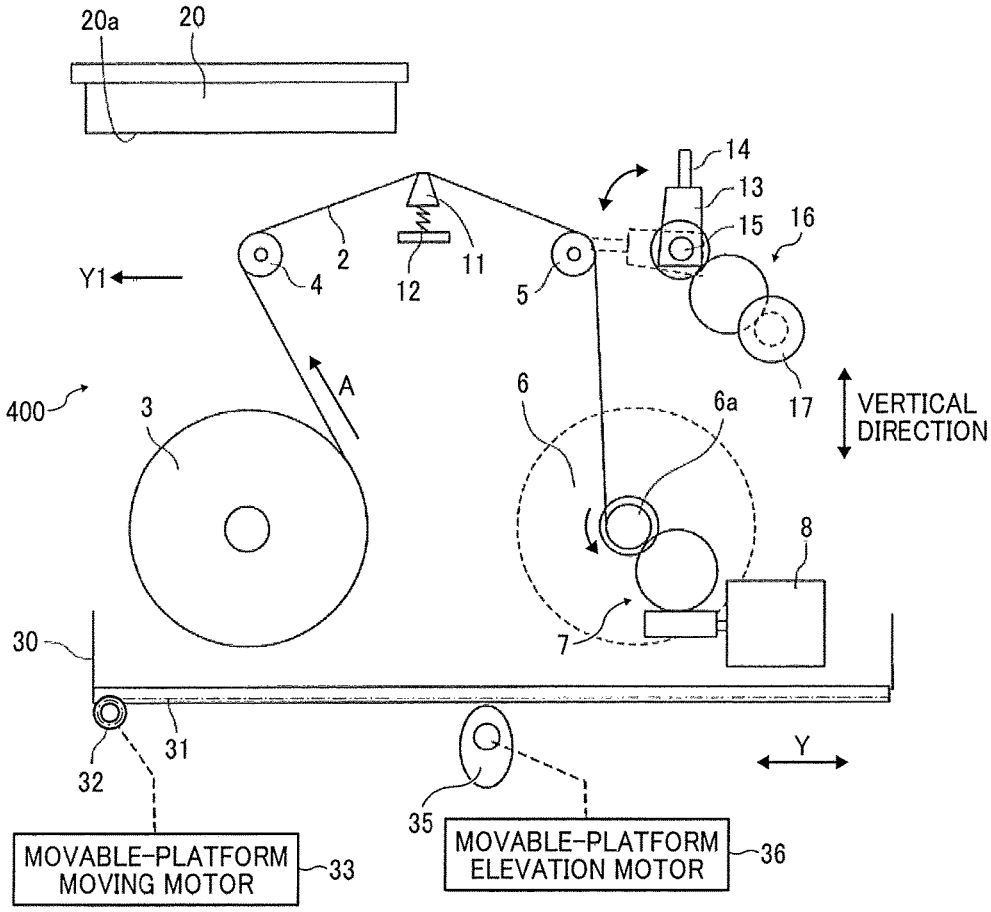
FIG. 17 is a schematic side view of a head cleaner according to a seventh embodiment of the present disclosure.

An eighth embodiment according to the present disclosure is described with reference to FIG. 17. FIG. 17 is a schematic side view of the head cleaner 400 according to the eighth embodiment of the present disclosure.

In the present embodiment, the relative positions of the feeding roller 3 and the winding roller 6 is opposite to the positional relationship in FIGS. 1 through 16 in the wiping direction Y1. A winding direction of the web 2 in the present embodiment is also opposite to the winding direction in FIGS. 1 through 16. A conveyance direction (moving direction A) of the web 2 (first wiper) is a direction from downstream side to the upstream in the wiping direction Y1. Thus, the web 2 (first wiper) is conveyed in a direction from downstream side to upstream in the wiping direction Y1 of the web 2 (first wiper).

Thereby, even if the waste liquid drops from the wiper 14 disposed upstream of the web 2 in the wiping direction Y1, the waste liquid drops to the used region of the web 2. Thus, the present embodiment can prevent deterioration of the wiping performance (cleaning performance) of the web 2.

Here, the winding roller 6 is disposed below the wiper 14 (first wiper). The winding roller 6 winds the first wiper (web 2).

Thereby, even if the waste liquid drops from the wiper 14, the web 2 can receive the waste liquid dropped from the wiper 14. Thus, the present embodiment can prevent scattering of the waste liquid to the surroundings.

In the present embodiment, it is not limited to the configuration in FIG. 17 if the waste liquid adhered on the wiper 14 is removable. For example, the same changes as similar to the first to seventh embodiments described-above, such as the contact direction (angle) between the wiper 14 and the guide roller 5 and the outer shape of the guide roller 5 (circle or uneven shaped), may be made on the present embodiment if it can remove the waste liquid on the wiper 14 in the present embodiment in which the winding rotational direction of the web 2 is opposite to the first to seventh embodiments.

Figure 18:
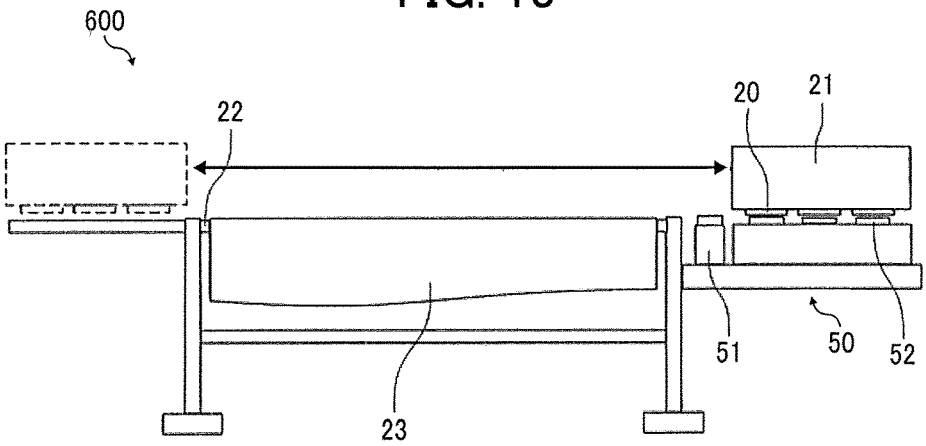
FIG. 18 is a front view of the liquid discharge apparatus including the head cleaner.
Figure 19:
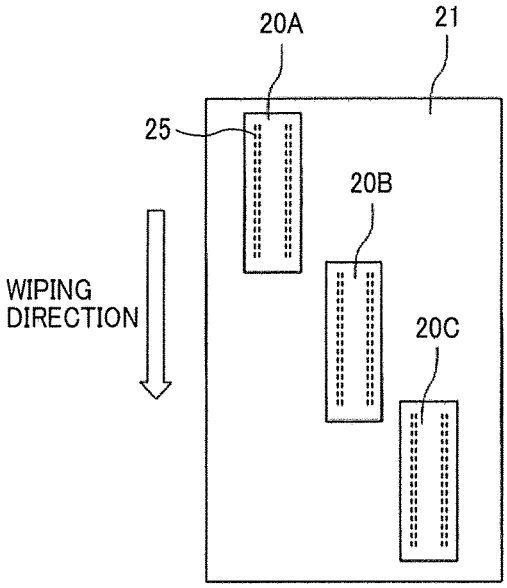
FIG. 19 is a schematic plan view of an arrangement of the head on a carriage of the liquid discharge apparatus.

FIGS. 18 and 19 illustrate a liquid discharge apparatus 600 including the head cleaner 400 according to the present disclosure. FIG. 18 is a front view of the liquid discharge apparatus 600. FIG. 19 is a schematic plan view of an arrangement of the head on a carriage 21 of the liquid discharge apparatus 600.

The liquid discharge apparatus 600 is a serial type apparatus in which one or a plurality of heads 20 (20A to 20C) are mounted on the carriage 21. The liquid discharge apparatus 600 conveys a medium 23 intermittently with the conveyer 22. The liquid discharge apparatus scans the carriage 21 in a main scanning direction as indicated by arrow in FIG. 18 and discharges liquid to the medium 23 from the head 20 to form an image on the medium 23.

The liquid discharge apparatus 600 includes a maintenance device 50 that maintain the head 20. The maintenance device 50 includes a cap 52 disposed at a home position side (right-hand side in FIG. 18) of the carriage 21. The cap 52 contacts and caps the nozzle face 20*a* of the head 20 to keep moisture inside the cap 52 and vacuuming up liquid from the cap 52 to maintain the cap 52. The maintenance device 50 further includes the head cleaner 400 as described in the first to seventh embodiments in FIGS. 1 through 17.

In this way, the first to eighth embodiments of the present disclosure includes the head cleaner 400. Thus, the present embodiments can reduce the maintenance time of the head 20 and clean the wiper with a simple configuration of the wipers (web 2 and wiper 14). Further, the present embodiments can clean the wiper 14 with an unused clean wiper (web 2).

Next, an example of a control circuit 700 of the liquid discharge apparatus 600 including the head cleaner 400 in the present embodiment is described with reference to FIG. 20.

Figure 20:
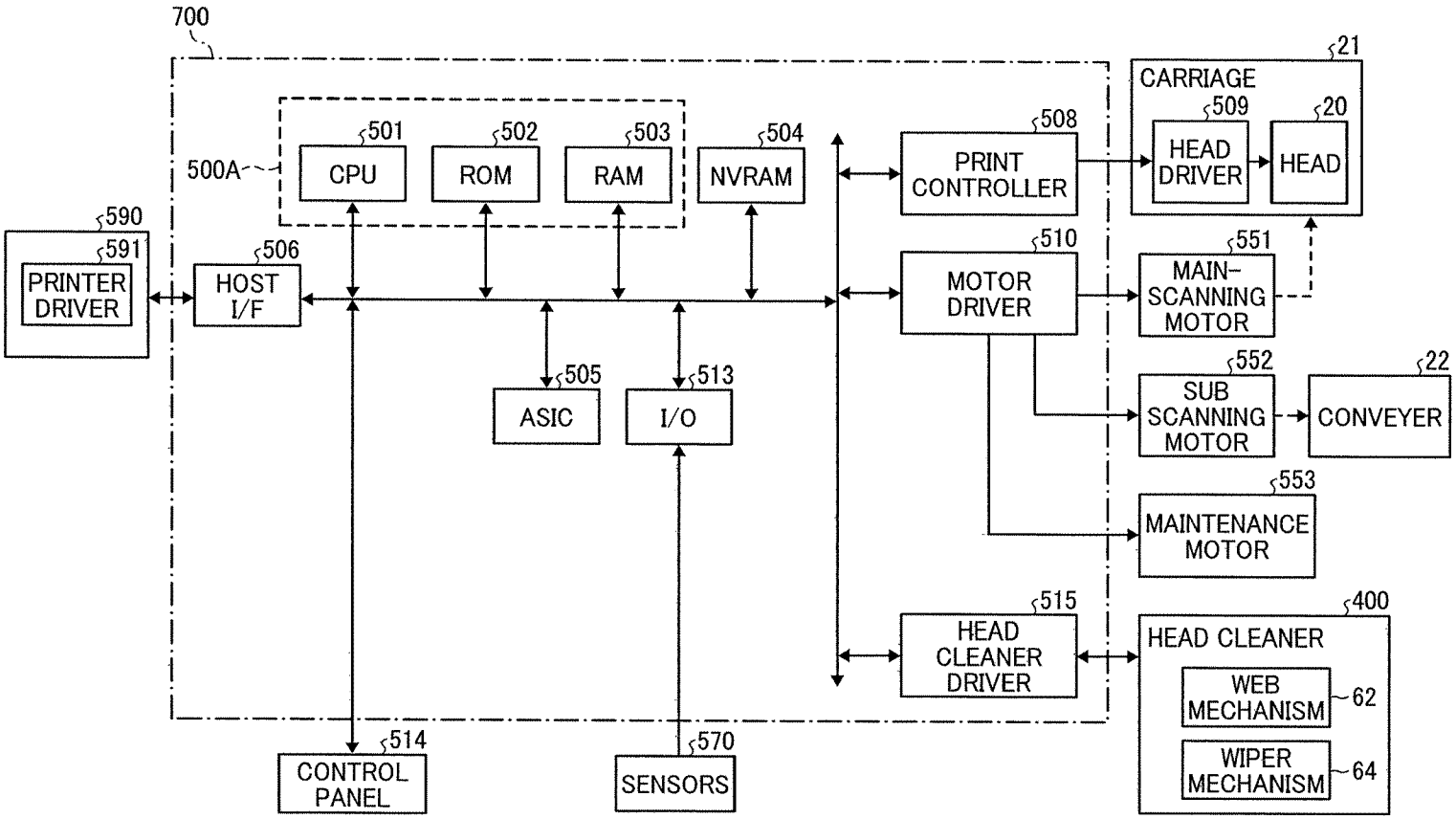
FIG. 20 is a block diagram of a control circuit of the liquid discharge apparatus.

FIG. 20 is a block diagram of the control circuit 700.

A control circuit 700 includes a main controller 500A. The main controller 500A includes a central processing unit (CPU) 501, a read-only memory (ROM) 502, and a random access memory (RAM) 503.

The CPU 501 manages the control of the entire three-dimensional fabricating apparatus 601. The ROM 502 stores programs executed by the CPU 501 and other fixed data. The programs stored in the ROM 502 include programs for causing the CPU 501 to execute a liquid discharge operation and the head cleaning operation according to embodiments of the present disclosure. The RAM 503 temporarily stores image data and other data.

The control circuit 700 further includes a nonvolatile memory (NVRAM) 504 to store the data even when power to the apparatus is blocked. In addition, the control circuit 700 further includes an application specific integrated circuit (ASIC) 505 to perform image processing to handle various signals related to image data and input/output signals to control the apparatus entirely.

The control circuit 700 includes a print controller 508 and a head driver (driver IC (Integral circuit)) 509. The print controller 508 includes a data transfer device and a driving signal generator to control driving of the heads 20. The head driver 509 drives the heads 20 provided on the carriage 21.

The control circuit 700 includes a motor driver 510. The motor driver 510 drives a main scanning motor 551, a sub scanning motor 552, and a maintenance motor 553. The main scanning motor 551 moves the carriage 21 of the liquid discharge apparatus 600 in the main scanning direction. The sub scanning motor 552 drives the conveyer 22. The maintenance motor 553 moves (ascends and descends) cap 52 of the head cleaner 400 vertically and drives a pump to vacuuming up inside the cap 52.

The control circuit 700 includes a head cleaner driver 515 to drive the head cleaner 51.

The control circuit 700 includes an input-output (I/O) unit 513 to receive information from various sensors 570 such as a temperature sensor mounted on other devices in the liquid discharge apparatus 600. The control circuit 700 extracts information necessary for controlling the liquid discharge apparatus 600 and uses such information to perform various controls.

The control circuit 700 is connected to a control panel 514 through which necessary information for the liquid discharge apparatus 600 is input or displayed.

The controller 500 includes a host interface (I/F) 506 to transmit and receive data and signals to and from a host 590, and receives data and signals by the host I/F 506 from a printer driver 591 of the host 590, such as an information processing device (e.g., personal computer), an image reading device, or an image pick-up device, via a cable or network.

The CPU 501 of the control circuit 700 reads and analyzes print data stored in a reception buffer of the I/F 506, performs desired image processing, data sorting, or other processing with the ASIC 505, and transfers image data from the print controller 508 to the head driver 509.

The print controller 508 transfers the above-described image data as serial data and outputs to the head driver 509, for example, transfer clock signals, latch signals, and control signals required for the transfer of image data and determination of the transfer.

In addition, the print controller 508 includes the driving signal generator including, e.g., a digital/analog (D/A) converter (to perform digital/analog conversion on pattern data of driving pulses stored on the ROM 502), a voltage amplifier, and a current amplifier. The print controller 508 generates a driving waveform containing one or more driving pulses from the driving signal generator to the head driver 509.

In accordance with serially-inputted image data corresponding to one line discharged by the heads 20, the head driver 509 selects driving pulses of a driving waveform transmitted from the print controller 508 and applies the selected driving pulses to the pressure generator to drive the heads 20. At this time, by selecting a part or all of the driving pulses forming the driving waveform or a part or all of waveform elements forming a driving pulse, the heads 20 can selectively discharge dots of different sizes, e.g., large droplets, medium droplets, and small droplets.

The head cleaner 400 includes a web mechanism 62 that includes the web 2 and a wiper mechanism 64 that includes the wiper 14.

The wiper mechanism 64 can moves the position of the wiper 14 between the first position and the second position as described in the second embodiment. The web 2 contacts the nozzle face 20*a* and the wiper 14 contacts the nozzle face 20*a* at the first position. Thus, the wiping operation of both the web 2 and the wiper 14 is possible in the first position.

The web 2 contacts the nozzle face 20*a*, and the wiper 14 does not contact the nozzle face 20*a* in the second position.

Thereby, the head cleaner 400 in the liquid discharge apparatus 600 includes a first mode and a second mode. The first mode wipes the nozzle face 20*a* with the web 2 and the wiper 14. The second mode wipes the nozzle face 20*a* only by the web 2 (without using the wiper 14).

The wiping mode of the first mode and the second mode may be performed according to the print setting of the user. For example, whether the wiping operation is performed according to the first mode or the second mode may be determined with related the print mode before the wiping operation.

Specifically, the wiping operation of the first mode (use web 2 and wiper 14) is performed after performing mass printing or after a printing of using large amount of ink.

On the other hand, the wiping operation of the second mode (use web 2 only without using wiper 14) is performed when print volume is small or when the amount of ink used for a predetermined period is small.

Selection of the modes may be set from the control panel 514 or the host 590 side.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

"The liquid discharge device" is an integrated unit including the liquid discharge head and a functional part(s) or unit(s), and is an assembly of parts relating to liquid discharge. For example, "the liquid discharge device" may be a combination of the head 20 with at least one of a head tank, a carriage 21, a supply unit, a maintenance device 50, and a main scanning moving unit to move (scan) the carriage 21 in the main scanning direction.

Here, examples of the integrated unit include a combination in which the liquid discharge head and a functional part(s) are secured to each other through, e.g., fastening, bonding, or engaging, and a combination in which one of the liquid discharge head and a functional part(s) is movably held by another. The liquid discharge head may be detachably attached to the functional part(s) or unit(s) each other.

For example, the liquid discharge head and a head tank are integrated as the liquid discharge device. The liquid discharge head and the head tank may be connected each other via, e.g., a tube to integrally form the liquid discharge device. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by a guide that forms part of a main scan moving unit, so that the liquid discharge head and the main scan moving unit are integrated as a single unit. The liquid discharge device may include the liquid discharge head, the carriage, and the main scan moving unit that are integrated as a single unit.

In another example, the cap that forms part of the maintenance device is secured to the carriage mounting the liquid discharge head so that the liquid discharge head, the carriage, and the maintenance device are integrated as a single unit to form the liquid discharge device.

Further, in another example, the liquid discharge device includes tubes connected to the liquid discharge head mounted on the head tank or the channel member so that the liquid discharge head and the supply assembly are integrated as a single unit. Liquid is supplied from a liquid reservoir source to the liquid discharge head through the tube.

The main scan moving unit may be a guide only. The supply unit may be a tube(s) only or a loading unit only.

The term "liquid discharge apparatus" used herein also represents an apparatus including the liquid discharge head or the liquid discharge device to discharge liquid by driving the liquid discharge head. The liquid discharge apparatus may be, for example, an apparatus capable of discharging liquid to a material, to which liquid can be adhered, or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to form an image on a sheet by discharging ink, or a three-dimensional fabrication apparatus to discharge a fabrication liquid to a powder layer in which powder material is formed in layers, so as to form a three-dimensional fabrication object.

In addition, "the liquid discharge apparatus" is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "medium on which liquid can be adhered" include recording media, such as paper sheet, recording paper, recording sheet of paper, film, and cloth, electronic component, such as electronic substrate and piezoelectric element, and media, such as powder layer, organ model, and testing cell. The "medium on which liquid can be adhered" includes any medium on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

"The liquid discharge apparatus" may be an apparatus to relatively move a liquid discharge head and a medium on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of "the liquid discharge apparatus" further include a treatment liquid coating apparatus to discharge a treatment liquid to a sheet to coat the sheet with the treatment liquid to reform the sheet surface and an injection granulation apparatus to eject a composition liquid including a raw material dispersed in a solution from a nozzle to mold particles of the raw material.

The terms "image formation", "recording", "printing", "image printing", and "fabricating" used herein may be used synonymously with each other.

The structures described above are just examples, and the various aspects of the present specification attain respective effects as follows.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A head cleaner for a liquid discharge apparatus, the head cleaner comprising:

a first wiper to wipe, in a wiping direction, a nozzle face of a head that discharges liquid from nozzles formed on the nozzle face; and a second wiper to wipe the nozzle face of the head, wherein the first wiper is belt-shaped, and the second wiper is a blade and is configured to be moved between a wiping position where the second wiper wipes the nozzle face after the first nozzle wipes the wiper face and a cleaning position where the second wiper does not contact the nozzle face and is cleaned by the first wiper.

2. The head cleaner according to claim 1, wherein the second wiper is retractable to a retracted position where the second wiper does not contact the nozzle face when the first wiper wipes the nozzle face.

3. The head cleaner according to claim 1, further comprising a movable platform that mounts the first wiper and the second wiper, wherein the movable platform moves relative to the head in the wiping direction.

4. The head cleaner according to claim 1, further comprising a guide roller that guides a conveyance of the first wiper, wherein the second wiper faces the guide roller via the first wiper at the cleaning position.

5. The head cleaner according to claim 4, wherein the guide roller has an uneven shape.

6. The head cleaner according to claim 1, wherein the first wiper is conveyed in a direction from upstream to downstream in the wiping direction of the first wiper, and the cleaning position of the second wiper is disposed upstream of a contact position where the first wiper contacts the nozzle face of the head.

7. The head cleaner according to claim 1, wherein the second wiper is disposed upstream of the first wiper in the wiping direction.

8. The head cleaner according to claim 1, wherein the first wiper is conveyed in a direction from downstream to upstream in the wiping direction of the first wiper.

9. The head cleaner according to claim 1, further comprising:

a feeding roller to feed the first wiper to the nozzle face of the head; and a shield disposed in a space between the feeding roller and the first wiper.

10. The head cleaner according to claim 9, wherein the shield advances and retracts in the wiping direction.

11. A maintenance device for a head that discharges liquid from nozzles, the device comprising:

a cap to cap the head; and the head cleaner according to claim 1.

12. A liquid discharge apparatus comprising:

a head to discharge liquid from nozzles; and the head cleaner according to claim 1.

* * * * *